US008130099B2

(12) United States Patent
Steinel et al.

(10) Patent No.: US 8,130,099 B2
(45) Date of Patent: Mar. 6, 2012

(54) SENSOR LIGHT

(75) Inventors: Heinrich Wolfgang Steinel, Bad Wörishofen (DE); Martin Meggle, Herzebrock-Clarholz (DE); Christof Herbst, Herzebrock-Clarholz (DE); Thomas Möller, Herford (DE)

(73) Assignee: Steinel GmbH, Herzebrock-Clarholz (DE)

( * ) Notice: Subject to any disclaimer, the term of this patent is extended or adjusted under 35 U.S.C. 154(b) by 1079 days.

(21) Appl. No.: 11/720,596

(22) PCT Filed: Dec. 1, 2005

(86) PCT No.: PCT/EP2005/012822

§ 371 (c)(1),
(2), (4) Date: Oct. 22, 2007

(87) PCT Pub. No.: WO2006/058742

PCT Pub. Date: Jun. 8, 2006

(65) Prior Publication Data

US 2008/0204230 A1 Aug. 28, 2008

(30) Foreign Application Priority Data

Dec. 1, 2004 (DE) ..... 20 2004 018 647 U

(51) Int. Cl.
*G08B 13/00* (2006.01)
*F21V 23/04* (2006.01)

(52) U.S. Cl. ..... 340/541; 340/567; 362/276

(58) Field of Classification Search ..... 340/565, 340/567

See application file for complete search history.

(56) References Cited

U.S. PATENT DOCUMENTS

| | | | | |
|---|---|---|---|---|
| 4,271,359 | A | 6/1981 | Herwig et al. | 250/347 |
| 5,921,661 | A | 7/1999 | Eusterbrock et al. | 362/276 |
| 6,091,200 | A | 7/2000 | Lenz | 315/159 |
| 7,339,471 | B1 * | 3/2008 | Chan et al. | 340/541 |
| 2003/0014660 | A1 | 1/2003 | Verplaetse et al. | 713/200 |
| 2004/0061611 | A1 | 4/2004 | Rolf et al. | |
| 2005/0200495 | A1 | 9/2005 | Sibalich et al. | 340/693.11 |
| 2008/0068841 | A1 * | 3/2008 | Chi et al. | 362/276 |
| 2009/0224699 | A1 * | 9/2009 | Chi et al. | 315/362 |

FOREIGN PATENT DOCUMENTS

| | | | |
|---|---|---|---|
| DE | 19517517 | A1 | 11/1995 |
| EP | 1398742 | A1 | 3/2004 |
| WO | 9844467 | A1 | 10/1998 |

* cited by examiner

*Primary Examiner* — Brian Zimmerman
*Assistant Examiner* — Sara Samson
(74) *Attorney, Agent, or Firm* — Bachman & LaPointe, P.C.

(57) ABSTRACT

Sensor light having a light unit which can be activated in response to a sensor output signal from a motion sensor unit (16), and is provided on a support unit (10, 12) for installing the sensor light inside or outside, wherein that the motion sensor unit is modular, can be removed from the support unit when the latter is installed and has at least one actuating element (28) which can be manually operated and can be operated when the motion sensor unit has been removed.

17 Claims, 2 Drawing Sheets

SENSOR LIGHT

BACKGROUND OF THE INVENTION

The present invention relates to a sensor light according to the precharacterizing clause of the main claim. Such apparatuses are generally known from the prior art and are marketed in large quantities in the form of external lights or garden lights which are controlled by an infrared motion sensor, for instance.

The principle of these lights which are used to form the generic type is that a light unit which is of virtually any desired esthetic configuration and has a lighting means is fastened to a support unit (base unit) which, on the one hand, ensures that the light unit is supplied with electrical power and, on the other hand, enables the sensor light to be mechanically fastened to the wall of a house or enables a fastening position of that kind. In addition, such lights contain a motion sensor system which, typically integrated in the support unit, provides a lens window for a motion sensor that is arranged behind it and is sensitive to infrared radiation.

The associated sensor electronics integrated in the support unit then make it possible for the light element to be switched on and off under the control of the sensor in response to a detected movement, suitable environmental or operating parameters additionally being able to be set or preselected, for instance the level of ambient brightness at which the apparatus is actually activated, a lighting time in the activated state (before the light unit is automatically deactivated again) or a detection range of the sensor system. These parameters are usually dictated by the location or environment, with the result that any installed sensor light must first of all be suitably set before correct starting.

However, the problem with the sensor lights known from the prior art is that these parameters can be set only in the installed state (that is to say on the wall of a house, for instance), with the result that awkward handling is often needed to access the setting elements provided on the sensor light or support unit and/or the sensor unit; it is necessary to use a ladder, for instance, when lights are hung high up. In addition, it is often difficult to correctly set the brightness or dusk threshold value for activation of the light; this is then often carried out in respective semi-darkness (respectively associated with the disadvantage that the setting elements are accordingly difficult to detect).

Another disadvantage of the apparatuses known from the prior art is that the detection range is extremely inhomogeneous in the circumferential direction, in particular in the case of wide detection angles and the use of a mirror for interacting with an infrared motion sensor; this is due to the fact that, with typically two sensor individual elements of a motion sensor, certain optical irradiation conditions result in the sensor's image being projected onto the sensor setting elements in different ways depending on the circumferential position of a person moving relative to the sensor.

However, since the motion detection signal is based on a difference between the individual signals which are respectively output by the elements, positions exist in the circumferential direction in which both sensor individual elements equally receive infrared images and a usable sensor differential signal is thus not produced, that is to say the motion sensor therefore exhibits a sensitivity range and thus detection range which are extremely inhomogeneous in the environmental direction.

SUMMARY OF THE INVENTION

Therefore, it is an object of the present invention to first of all simplify handling of, and the ability to set, sensor lights, which form the generic type, in the installed state. In addition, the intention is to improve the range and sensitivity homogeneity of the motion sensor of a sensor light in the circumferential direction.

The object is achieved by means of the sensor light having the features and advantageous developments described herein.

This makes it possible, in a manner which is advantageous according to the invention, to install and operate the sensor light in a proven and known manner, but the modular motion sensor unit can be removed from the sensor light for the purpose of simplified handling and setting of the detection and operating parameters and, in this removed state, the operating parameters are then set in a simple manner without any problems.

In this case, according to the preferred development of the invention, it is particularly favorable for the removal of the motion sensor unit to trigger a predetermined illumination state of the sensor light, in particular continuous light of the light unit, thus also simplifying, in particular, a setting operation under poor ambient light conditions (for instance when setting a dusk threshold).

In a particularly suitable manner, the sensor housing which holds the motion sensor unit is cylindrical and can be pushed in, in which case, it is also preferred for the at least one actuating element to be concealed in the pushed-in state. This not only fosters an esthetically pleasing implementation of the sensor light as a whole but also advantageously protects the rotary regulators or switches, which are typically used as the actuating element, from environmental influences without having to take separate measures for this purpose. In addition, this measure makes it possible to provide the control elements or the surrounding housing surface with visible labels, advice or the like which considerably increase ease of operation and operational reliability without always then rendering it necessary to use external operating instructions, whereas these labels are invisible in the pushed-in state and thus do not adversely affect the esthetic appearance of the overall arrangement.

It is also particularly appropriate to provide the present invention with a motion sensor which detects a wide detection range, that is to say of greater than 180° and typically of up to 360°. This detection range is achieved, in a suitable manner, using a multifacet mirror which then interacts with the actual (infrared-sensitive) sensor, the sensor housing forming an encircling slot region for this purpose according to one development, infrared radiation being able to impinge on the mirror through said slot region in order to then be deflected to the sensor in a suitable manner.

According to one development and in order to improve or extend the detection range in a perpendicular plane, provision is also made to introduce a lens region into the sensor housing, said lens region being arranged on the end face of the latter, with the result that movements in an area directly below a suspended sensor light can also be detected, for instance.

Another preferred development of the invention also provides that the initially mentioned setting parameters and other setting parameters for the lighting and detection behavior of the sensor light—brightness threshold values, detection range, lighting time, illumination intensity in the quiescent state and activation state etc.—are not individually and separately set but rather that predetermined sets of parameters which are stored in the form of a program can be easily selected for this purpose by operating the actuating element. These sets of parameters are based on typical environmental scenarios which are set at the factory and stored, with the result that the (initial) setting complexity can be drastically reduced for the user of the sensor light who is installing and initially setting the latter.

According to one development, one particular variant of the invention involves making the data memory in the motion sensor unit, which memory is provided for the purpose of safeguarding the parameters or the like, accessible to external contact-connection, in particular in the removed state, using a suitable interface, for instance in such a manner that (in a similar manner to the known portable USB storage devices) the motion sensor unit is provided with a suitable, preferably standardized interface and maintenance personnel can thus use an external diagnosis unit (for example a suitably programmed PC) on site to access the unit, set and/or check operating parameters or even record and check an operating and/or control history of a device against the background of distinguishing technical errors from control errors, for instance. Other options associated with such an external interface with access to the data memory unit would also involve being able to update operating system software for the motion sensor unit ("firmware update"), in particular if the data memory unit which is provided according to one development is understood in a wider sense, beyond the pure storage of operating parameters, as being a nonvolatile program and database for the motion sensor unit.

According to another preferred embodiment, the motion sensor unit has, in order to implement the sensor system, four infrared-sensitive sensor elements which extend the known pair of sensor elements. This advantageously solves the problem (described at the outset) of the inhomogeneous detection range in the circumferential direction as a result of a highly varying sensitivity behavior since the four sensor elements which are suitably connected in pairs and are cross-connected are evaluated, according to the invention, in the form of two independent paths (containing respective sensor electronics), with the result that, even in the unfavorable case described at the outset in which both sensor elements of a pair of sensor elements simultaneously have an identical IR image applied to them, the respective other path outputs a detection signal which can be used to detect motion. A uniform homogeneous detection signal is then ensured for any case of the ambient position with a wide detection angle by logically ORing the two paths.

Another favorable development of the invention is also that the mirror element which interacts with the sensor (or the individual sensor elements) and is used to achieve the large detection angle can itself be set or adjusted such that the detection range can be set in this way in a simple and elegant manner (for instance by tilting or pivoting individual facets or all facets or segments of the mirror).

This thus results, in a surprisingly simple and elegant manner, in a sensor light which combines considerably improved detection properties with simplified production and simplified installation and setting properties.

BRIEF DESCRIPTION OF THE DRAWINGS

Further advantages, features and details of the invention emerge from the following description of preferred exemplary embodiments and with reference to the drawings, in which.

DETAILED DESCRIPTION

Figure 1:
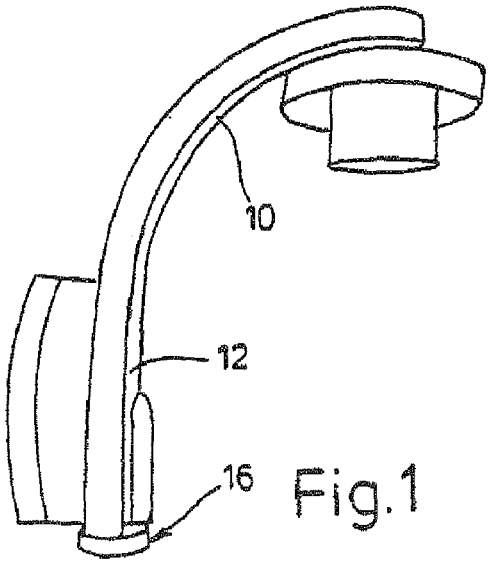
FIG. 1: shows a view of a sensor light according to a first exemplary embodiment of the present invention.
Figure 4:
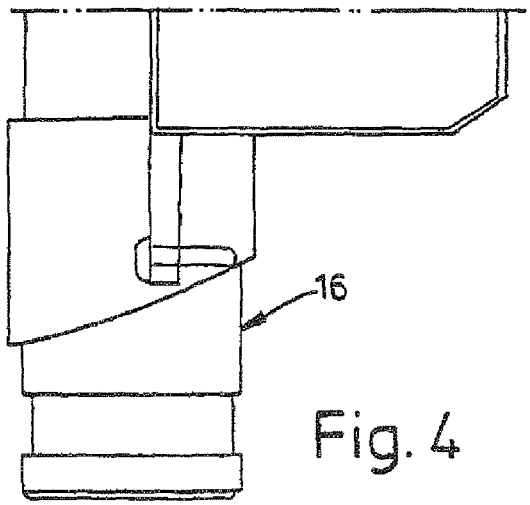
FIG. 4: shows a variant of the support unit with respect to FIG. 2 as a second exemplary embodiment.

The sensor light shown in FIG. 1 has a support unit which has an arm 10 and a wall section 12 and is made from a plastic material, a lighting means holder and a carrier for a lampshade (not shown) which surrounds the lighting means holder and thus the lighting means being provided at the end of the arm in an otherwise known manner. At the other end, a motion sensor unit 16 which can be pushed in using a cylindrical sensor housing 14 is provided in the lower region of the arm of the support unit such that it can be removed.

Figure 2:
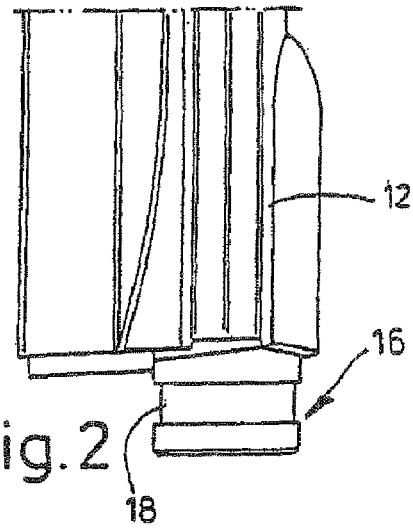
FIG. 2, FIG. 3: show the partial views of the lower region of the support unit of the sensor light shown in FIG. 1 with the modular motion sensor unit pushed in (FIG. 2) and, illustrated in an exploded manner, the removed state.
Figure 3:
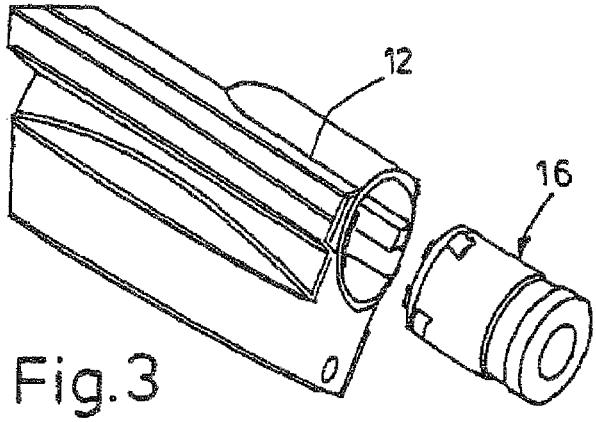

FIGS. 2 and 3 illustrate the relative relationship between the support unit of the sensor light and the sensor housing; FIG. 2 shows the sensor housing in the pushed-in state, an annular lens section 18 projecting from the housing formed by the support unit in the pushed-in state, whereas the remaining housing section is concealed in the light body. The exploded illustration of FIG. 3 illustrates the pulled-out state.

Figure 5:
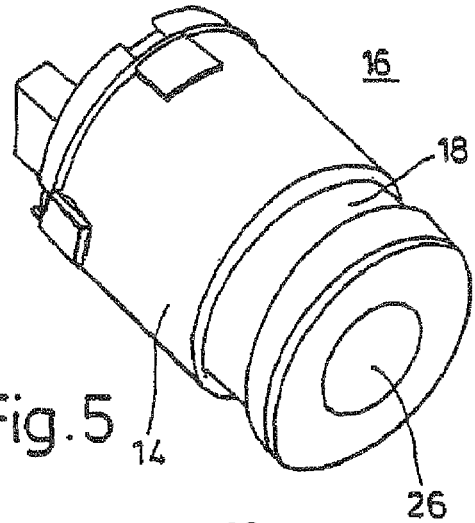
FIG. 5, FIG. 6: show perspective views of the modular motion sensor unit with different surfaces of the sensor housing.
Figure 6:
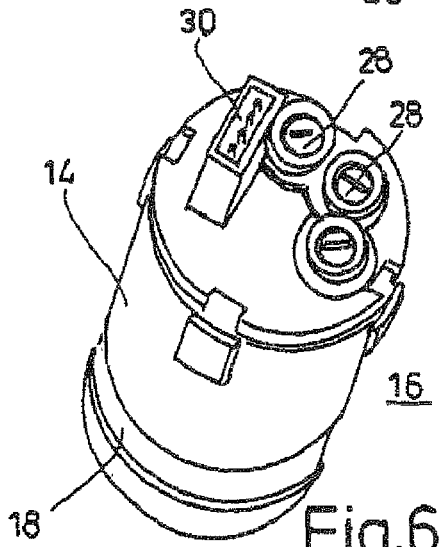
Figure 7:
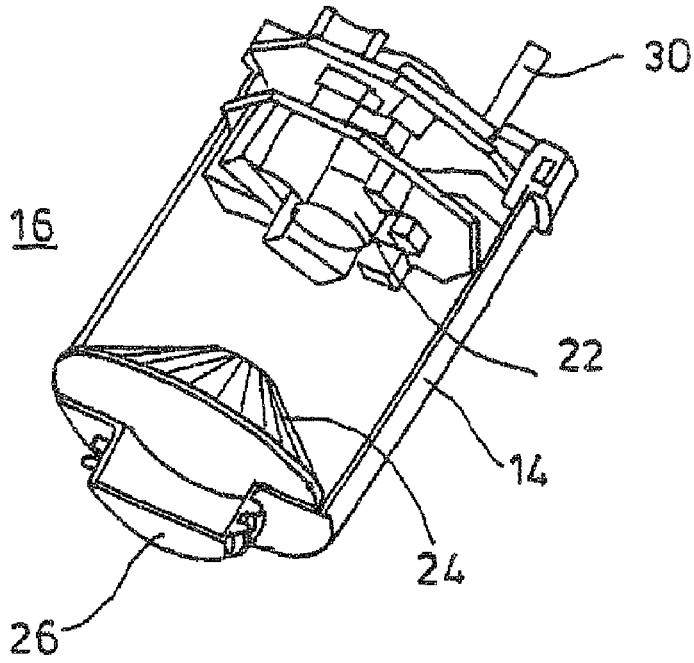
FIG. 7: shows a sectional view of the sensor housing shown in FIGS. 5, 6 with the internal mirror unit, sensor system and associated electronics.

The basic design of the sensor unit 16 is explained with reference to FIGS. 5 to 7. In this case, the cylindrical housing 14 made of a plastic material has, at one end, an electronic module 20 which, exposed toward the top, has, in addition to further electronic components, inter alia an infrared sensor 22 (in turn comprising an arrangement of four IR individual sensors which are connected to one another in pairs and are cross-connected). A facet mirror 24 in the form of segments of a cone is provided opposite the sensor 22 in the housing, said mirror being at the level of the laterally encircling lens region 18 in the housing 14 and being able to have incident radiation applied to it by the latter, which radiation is then deflected to the sensor 22 by the facets of the mirror unit 24. In addition, as shown in FIG. 5 and FIG. 7, the sensor housing has, on its end face, a further round lens region 26 through which incident radiation can directly fall onto the sensor 22 through a free central region of the mirror 24. At the base (that is to say adjacent to the electronic module 20), the housing 14 has actuating elements, which are accessible from the outside and are in the form of rotary regulators 28, and a connector 30 which is formed in the housing material, has corresponding plug contacts and is intended for electrical connection to further units which are provided in the support unit of the light, inter alia for supplying power and driving the light unit.

During use, the light shown in FIG. 1 is first of all installed on a wall or the like, for instance in the position shown, the lighting means is screwed in and the lampshade is put on. Following electrical connection, it is then possible to remove the motion sensor unit 16 in the manner shown in FIG. 3 and, in this removed state, to carry out the desired settings by operating the actuating elements 28. At this point in time (that is to say by removing the module), the light unit is changed to a continuous lighting state by suitably configuring the electronics in the support unit. After reinsertion (FIG. 2), the sensor light is then ready for motion detection operation in the set manner.

Figure 8:
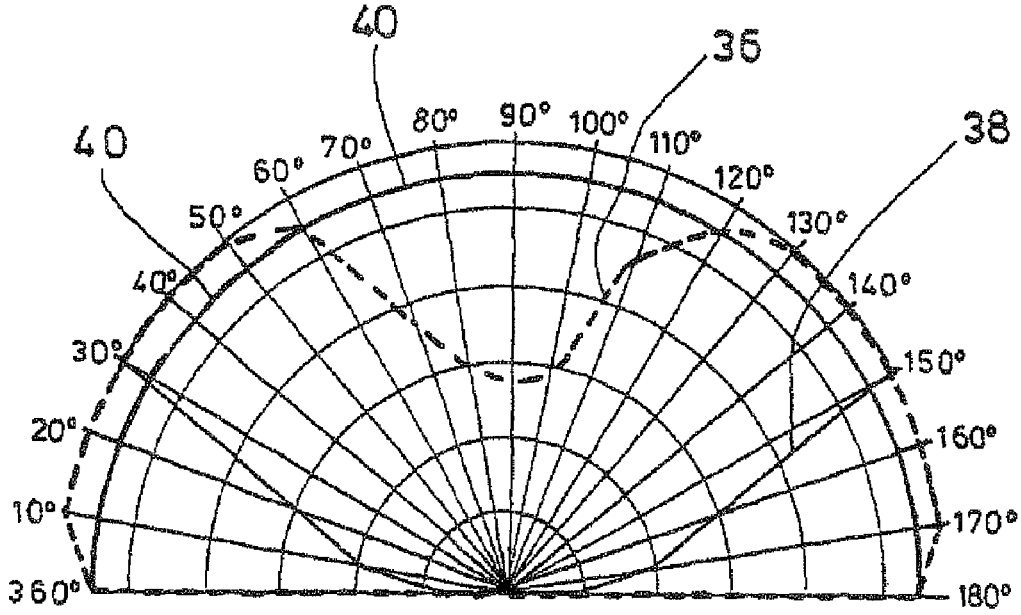
FIG. 8: shows a sensitivity/range detection diagram of the detection properties of the sensor light which has been provided with the motion sensor system shown in FIGS. 5-7 in comparison with known two-element sensors.

FIG. 8 illustrates the advantages which are achieved in the detection range by configuring the sensor 22 to have four sensors which are respectively connected in pairs: whereas the measurement curves provided with the reference symbols 36 and 38 illustrate a detection range whose angles are restricted or is highly inhomogeneous, as is the result of a typical customary two-element sensor, the measurement curve 40 shows the homogeneous profile measured using the sensor system of the present invention when four IR individual sensors which are respectively redundantly evaluated in pairs are used.

Whereas the present exemplary embodiments have focused on infrared motion sensors, the invention is not restricted thereto; in particular, the inventive concept of the modular motion sensor unit and its ability to be removed, together with all associated developments and advantages, is equally suitable for implementation using other motion sensor principles, for instance an ultrasonic sensor system or a radio-frequency sensor system. A (Doppler) motion sensor which acts on the basis of microwaves or more preferably a pulsed (Doppler) motion sensor, in particular, is then entirely suitable, for instance, as an alternative to the infrared sensor system, which alternative is technically equivalent or is even superior in other fields; such a refinement of the invention would make it possible, for instance, to render the sensor virtually invisible—for instance by extensive countersinking or measures of that kind in the support unit—since microwaves which penetrate the (plastic) housing walls would not require a separate sensor opening or a separate lens that is visible from the outside.

The invention claimed is:

1. Sensor light having a light unit which can be activated in response to a sensor output signal from a motion sensor unit (16), and is provided on a support unit (10, 12) for installing the sensor light inside or outside, characterized in that the motion sensor unit is modular, is removable from the support unit when the latter is installed and has at least one actuating element (28) which is manually operable and can be operated when the motion sensor unit has been removed, and wherein the light unit is fully operable with the motion sensor unit removed.

2. Sensor light according to claim 1, characterized in that the motion sensor unit (16) has a sensor housing (14) which is designed to interact with the support unit in pluggable fashion and establishes a mechanical connection and an electrical connection between the motion sensor unit and the support unit when the sensor housing has been pushed in.

3. Sensor housing according to claim 2, characterized in that the sensor housing has, at one end, a lens region (18, 26) which projects from the support unit when the sensor housing has been pushed in, and, at the other end, the actuating element (28) which is concealed in the pushed-in state is provided.

4. Sensor light according to claim 2, characterized in that the sensor housing (14) is cylindrical and has, at one end, the lens region (18) which is of encircling design and is in the form of a slot.

5. Sensor light according to claim 4, characterized in that the sensor housing has, on its end face, an additional lens region (26) which extends the detection range of the motion sensor unit.

6. Sensor light according to claim 1, characterized in that the sensor light is designed in such a manner that the light unit is activated in a predetermined activation state, in response to the motion sensor unit being removed from the support unit which has been installed and is ready for operation.

7. Sensor light according to claim 1, characterized in that the actuating element sets or selects at least one predetermined set of control parameters, which is prescribed in the form of a program, for lighting operation of the sensor light and/or detection conditions of the motion sensor unit.

8. Sensor light according to claim 1, characterized in that the motion sensor unit has a sensor (22) having four infrared-sensitive sensor elements, the sensor elements being separately assigned in pairs to a respective path which has signal electronics and being evaluated in such a manner that a detection signal of one of the paths activates the light unit.

9. Sensor light according to claim 8, characterized in that a mirror (24) which is provided in a sensor housing (14) of the motion sensor unit and has a plurality of facets is assigned to the sensor (22).

10. Sensor light according to claim 1, characterized in that the motion sensor unit has a detection angle of 360°.

11. Sensor light according to claim 1, characterized in that the motion sensor unit has means for setting a detection range.

12. Sensor light according to claim 1, characterized in that the motion sensor unit has a memory unit, which is set up to store operating parameters, and an interface which is assigned to said memory unit and allows the operating parameters to be accessed.

13. Sensor light according to claim 1, wherein the sensor unit acts on the basis of infrared.

14. Sensor light according to claim 6, wherein the predetermined activation state is continuous light.

15. Sensor light according to claim 11, wherein the means for setting a detection range comprises means for varying the position of a mirror unit which interacts with a sensor of the motion sensor unit.

16. Sensor light according to claim 12, wherein the interface allows the operating parameters to be accessed using a data processing apparatus which can be connected to the interface in the removed state.

17. Sensor light according to claim 1, wherein the motion sensor unit (16) is removable from the support unit without removing any other components of the sensor light.

* * * * *